US010799752B1

(12) United States Patent
Mattox et al.

(10) Patent No.: US 10,799,752 B1
(45) Date of Patent: Oct. 13, 2020

(54) ADJUSTABLE TRAP BAR

(71) Applicants: Ernest Michael Mattox, Holt, MO (US); Alex Shmuylovich, Edison, NJ (US)

(72) Inventors: Ernest Michael Mattox, Holt, MO (US); Alex Shmuylovich, Edison, NJ (US)

( * ) Notice: Subject to any disclaimer, the term of this patent is extended or adjusted under 35 U.S.C. 154(b) by 0 days.

(21) Appl. No.: 16/868,446

(22) Filed: May 6, 2020

Related U.S. Application Data

(62) Division of application No. 16/546,284, filed on Aug. 20, 2019.

(51) Int. Cl.
*A63B 21/072* (2006.01)
*A63B 21/078* (2006.01)

(52) U.S. Cl.
CPC ..... *A63B 21/0724* (2013.01); *A63B 21/0783* (2015.10)

(58) Field of Classification Search
CPC ..... A63B 21/0724; A63B 21/0783; A63B 21/072; A63B 21/0722; A63B 21/0728; A63B 2244/09; A63B 23/04; A63B 23/0405; A63B 2023/0411; A63B 2210/50; A63B 2225/09
See application file for complete search history.

(56) References Cited

U.S. PATENT DOCUMENTS

| | | | | |
|---|---|---|---|---|
| 4,018,442 | A * | 4/1977 | Galler | A63B 21/0724 482/106 |
| 6,004,245 | A * | 12/1999 | Boos | A63B 21/072 482/106 |
| 6,679,815 | B2 * | 1/2004 | Vittone | A63B 21/06 482/106 |
| 9,682,274 | B1 * | 6/2017 | Ekstrom | A63B 21/0602 |
| 10,188,899 | B1 * | 1/2019 | Acuna, Jr. | A63B 21/4035 |
| 2004/0242385 | A1 * | 12/2004 | Emick | A63B 21/0783 482/106 |

* cited by examiner

*Primary Examiner* — Jennifer Robertson
*Assistant Examiner* — Kathleen Vermillera
(74) *Attorney, Agent, or Firm* — Koffsky Schwalb LLC; Mark I. Koffsky

(57) ABSTRACT

Embodiments of improved closed-piece and open-piece trap bar having adjustable properties that enable the user to have a safer and more effective weightlifting experience. Closed-piece trap bars comprise include a trap bar wherein the user steps into a structure that entirely surrounds him or her during the lifting and lowering process. Open-piece trap bars comprise include a trap bar wherein the user steps into a structure that partially surrounds him or her during the lifting and lowering process. These trap bars are adjustable either because the width of the trap bar itself may be adjusted or the length of the handles may be adjusted or the space in between the handles may be adjusted.

12 Claims, 11 Drawing Sheets

ADJUSTABLE TRAP BAR

FIELD OF THE DISCLOSURE

The present disclosure relates generally to improved designs for an adjustable trap bar used for weightlifting exercises.

BACKGROUND

Weightlifting is a significant part of many exercise regimens. Using barbells, dumb-bells and the like provide the foundation of resistance based training that increases user strength. Traditional barbell design involves a straight piece with weights secured to either side thereto. The user lifts the weights via the center part of the straight piece.

Introduced in the 1980s, the trap bar is a device that replaces the center part of the straight piece between the secured weights found in a traditional barbell with a generally closed piece, which may be, for example, diamond, hexagonal or rectangular in shape. The weightlifter places himself or herself in the middle of the closed piece and lifts the secured weights using handlebars that are attached to each side of the closed piece.

Early trap bar embodiments are disclosed in U.S. Design Pat. Nos. 317,641 and 320,249, both invented by Al P. Gerard.

The advantages of a trap bar over a barbell for deadlift weightlifting include:

A) it may be easier to learn than the barbell deadlift.

B) there may be no hyperextension at lockout.

C) there may be no need for a mixed grip.

D) the high handles are useful for people with insufficient hip range of motion.

E) there may be less chance of getting pulled forward/spinal flexion.

F) the trap bar may still be just as hip-dominant as a barbell deadlift.

G) there may be better skill transfer to other sports.

SUMMARY

The present invention is directed to a number of improved closed-piece and open-piece trap bar embodiments having adjustable properties that enable the user to have a safer and more effective weightlifting experience.

BRIEF DESCRIPTION OF THE FIGURES

The accompanying figures, where like reference numerals refer to identical or functionally similar elements throughout the separate views, together with the detailed description below, are incorporated in and form part of the specification, and serve to further illustrate embodiments of concepts that include the claimed invention, and explain various principles and advantages of those embodiments.

Figure 1:
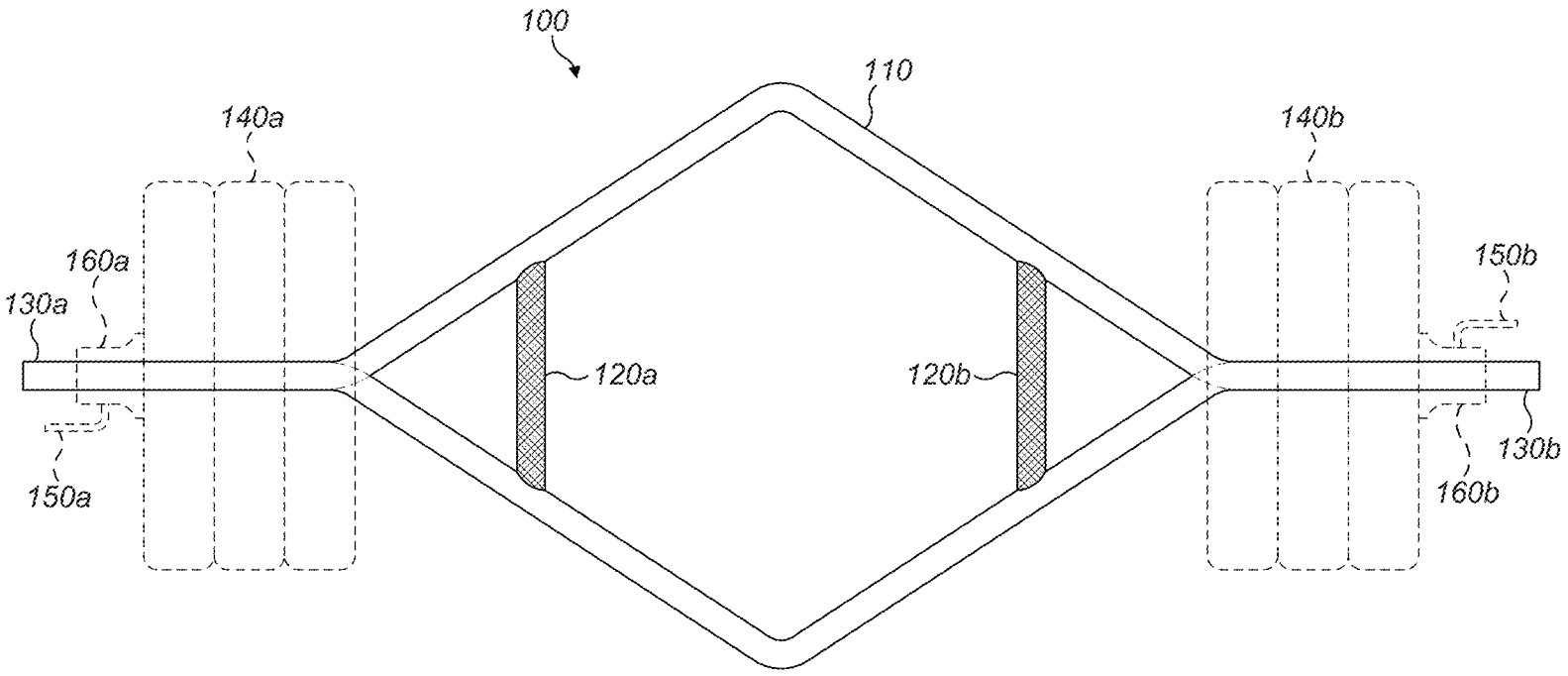
FIG. 1 Prior Art
FIG. 1 shows an embodiment of a closed-piece trap bar in the prior art.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present invention.

The apparatus and method components have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein.

DETAILED DESCRIPTION

I. The Prior Art

Turning to FIG. 1, shown is a trap bar embodiment in the prior art. (This figure is essentially identical to FIG. 1 of U.S. Design Pat. No. 317,641.) In this trap bar embodiment 100, a diamond-shaped closed piece 110 forms the foundation of the trap bar embodiment 100. Fused to the diamond-shaped closed piece 110 are two handles 120*a*, 120*b*, each on opposite sides. Also fused to the diamond-shaped closed piece 110 are weight-loading bars 130*a*, 130*b*, each on opposite sides. Prior to using the trap bar embodiment 100 for weightlifting, a user places weights 140*a*, 140*b* on each weight-loading bar 130*a*, 130*b*, secures the weights 140*a*, 140*b* with a securing mechanism 160*a*, 160*b* and locks the securing mechanism 160*a*, 160*b* with a locking mechanism 150*a*, 150*b*. The user then steps within the diamond-shaped closed piece 110 and uses the handles 120*a*, 120*b* to lift the weights 140*a*, 140*b*.

II. New and Improved Embodiments

The present application provides significant new and improved embodiments over the foregoing trap bar embodiment 100. Such new embodiments may comprise adjustable closed-piece trap bars and adjustable open-piece trap bars.

In the examples of closed-piece trap bars and open-piece trap bars, locking and securing mechanisms will be discussed herein. Such locking and securing mechanisms may be of any type, including: bolts and nuts, pop pin, locking nut/jam nut, slotted/castle nut, locking plates, slotted nut; screws and tapped holes; threaded components that fasten together; and thread locking components via lock washers, nylon insert lock (nylock) nut, safety wire, castle nut/safety clip/retainer pin.

A. Closed-Piece Trap Bars

Closed-piece trap bars comprise a trap bar wherein the user steps into a structure that entirely surrounds him or her during the lifting and lowering process. The surrounding materials may be made of any material that can withstand the weightlifting process, including without limitation metal, plastic and the like.

In the examples of closed-piece trap bars set forth herein, a rectangular shape is shown for the closed piece. Nevertheless, other shapes of the closed piece may be used including without limitation, circular, oval, hexagonal and the like.

1. Closed-Piece Integrated Adjustable Bar Length Handle Spacing System

Figure 2:
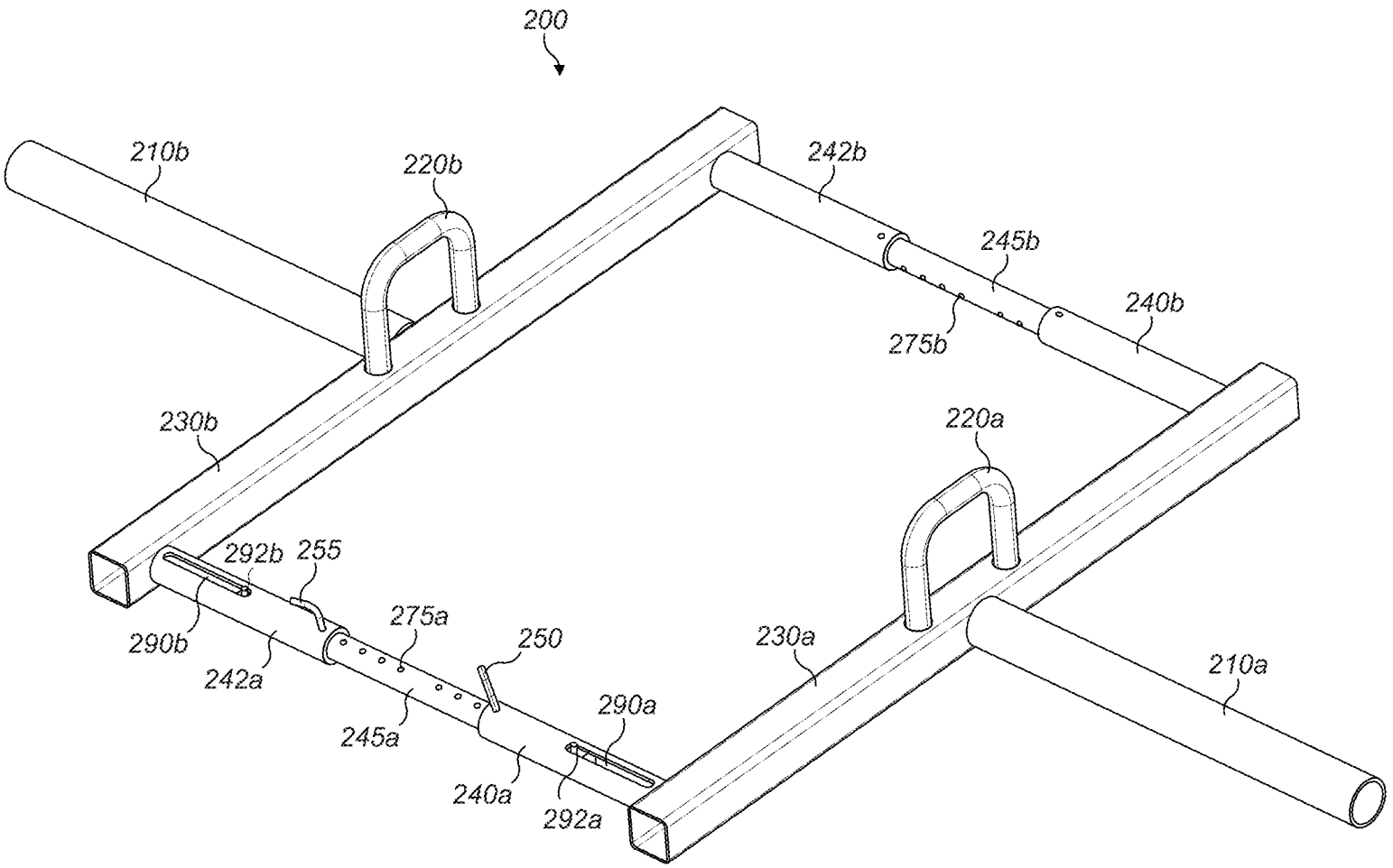
FIG. 2 shows an embodiment of a closed-piece trap bar with an integrated adjustable bar length handle spacing system.

Turning to FIG. 2, shown is an embodiment 200 of a closed-piece trap bar with an integrated adjustable bar-length handle spacing system. In this FIG. 2, the front is facing toward the two front sleeve pieces 240*a*, 242*a*. The closed-piece comprises a left side piece and a right side piece 230*a*, 230*b*, one on each side. Fused to each of the side pieces 230*a*, 230*b* are handles 220*a*, 220*b* and weight-loading bars 210*a*, 210*b*.

The front of the trap bar includes two front sleeve pieces 240*a*, 242*a* that are partially or fully hollow and built to encompass and slide along a front expansion piece 245*a*. The right side of the right front sleeve piece 242*a* is fused to the front side of the right side piece 230*b*. The left side of the left front sleeve piece 240*a* is fused to the front side of the left side piece 230*a*. In an alternative embodiment, the left side of the right front sleeve piece 242*a* is also fused to the right of the front expansion piece 245*a*. In an alternative embodiment, the right side of the left front sleeve piece 240*a* is also fused to the left of the front expansion piece 245*a*.

The back of the trap bar includes two back sleeve pieces 240*b*, 242*b* that are partially or fully hollow and built to encompass and slide along a back expansion piece 245*b*. The right side of the right back sleeve piece 242*b* is fused to the back side of the right side piece 230*b*. The left side of the left back sleeve piece 240*b* is fused to the back side of the left side piece 230*a*. In an alternative embodiment, the left side of the right back sleeve piece 242*b* is also fused to the right of the back expansion piece 245*b*. In an alternative embodiment, the right side of the left back sleeve piece 240*b* is also fused to the left of the back expansion piece 245*b*.

The front expansion piece 245*a* may include a plurality of locking holes 275*a* where the front expansion piece can be secured using one or more of locking mechanisms 250, 255. The locking mechanisms 250, 255 work in tandem with retaining slots 290*a*, 290*b* and stopper bolts 292*a*, 292*b* serve to control the expansion of the telescoping tubes to prevent them from coming apart. Alternatively, securing mechanisms (not shown) may be threaded through sleeve piece cutouts 240*b*, 242*b* to secure the back expansion piece 245*b*. In the alternative, threading may be used to secure the back expansion piece 245*b*.

The construction of the trap bar allows the user to adjust the trap bar by making it wider or narrower depending on user preference. In order to accomplish this, the user unlocks one or more of the locking mechanisms 250, 255. This allows the trap bar to increase or decrease in width depending on the preference of the user. Once the width of the trap bar is set to the user's preference, the user then locks one or more of the locking mechanisms 250, 255 to secure that width during use.

The user then loads and secures weights (not shown) on the weight-loading bars 210*a*, 210*b*. The user then steps within the trap bar and uses the handles 220*a*, 220*b* to lift and lower the trap bar.

The trap bar shown in FIG. 2 may incorporate the securing leg options discussed below with respect to FIGS. 7A and 7B.

2. Closed-Piece Integrated Adjustable Handle Spacing System

Figure 3A:
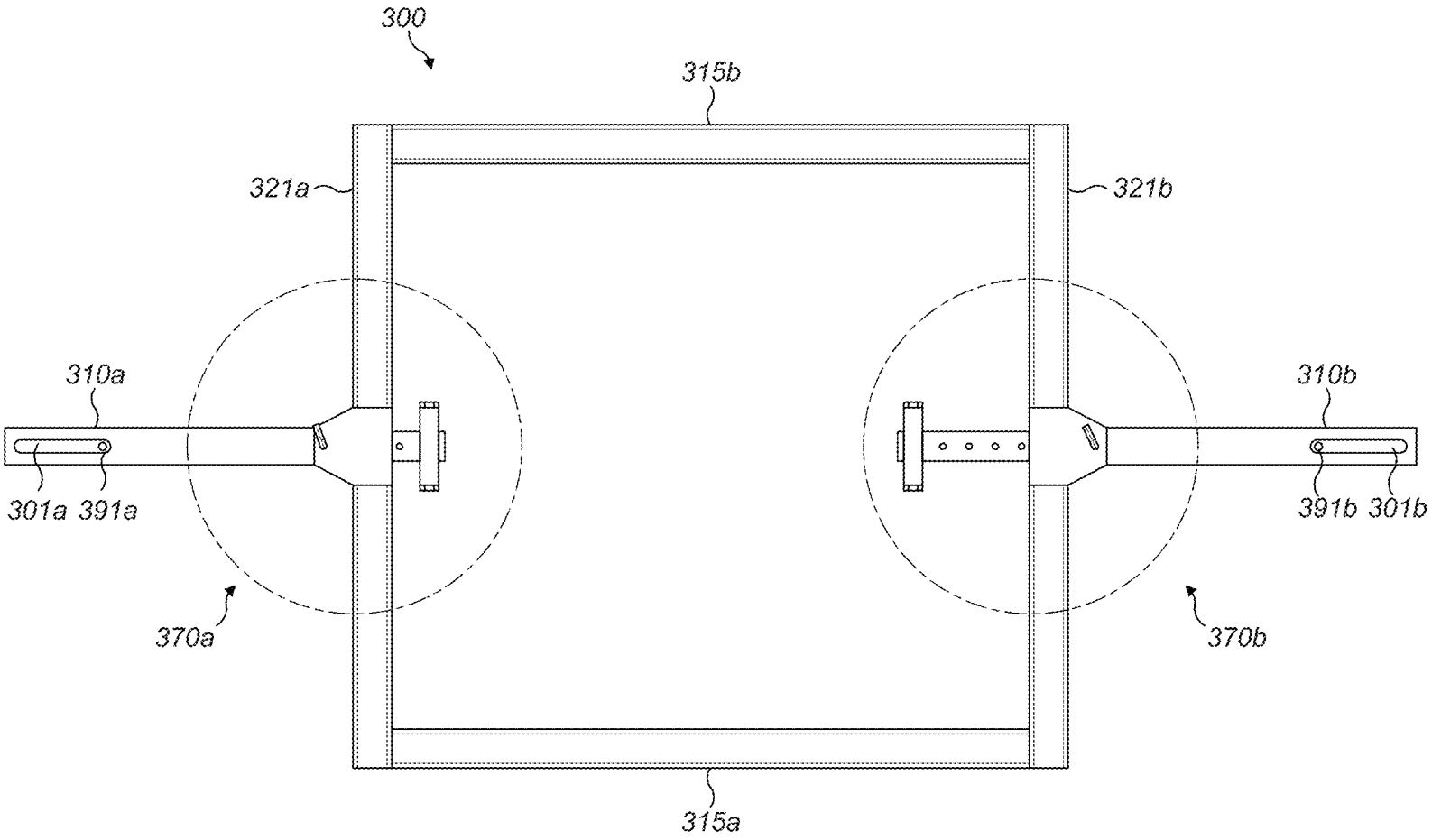
FIGS. 3A, 3B and 3C show an embodiment of a closed-piece trap bar with an integrated adjustable handle spacing system.

Turning to FIG. 3A, shown is an embodiment 300 of a closed-piece trap bar with an integrated adjustable handle spacing system. In this FIG. 3A, the front is facing toward the front piece 315*b*. The closed-piece trap bar comprises a front piece 315*b*, a back piece 315*a*, a right side piece 321*b* and left side piece 321*a*, all fused so as to create a rectangular shape. Fused to each of the side pieces 321*a*, 321*b* are hollow weight-loading bars 310*a*, 310*b* each having a retaining slot 301*a*, 301*b* and stopper bolts 391*a*, 391*b*.

Figure 3B:
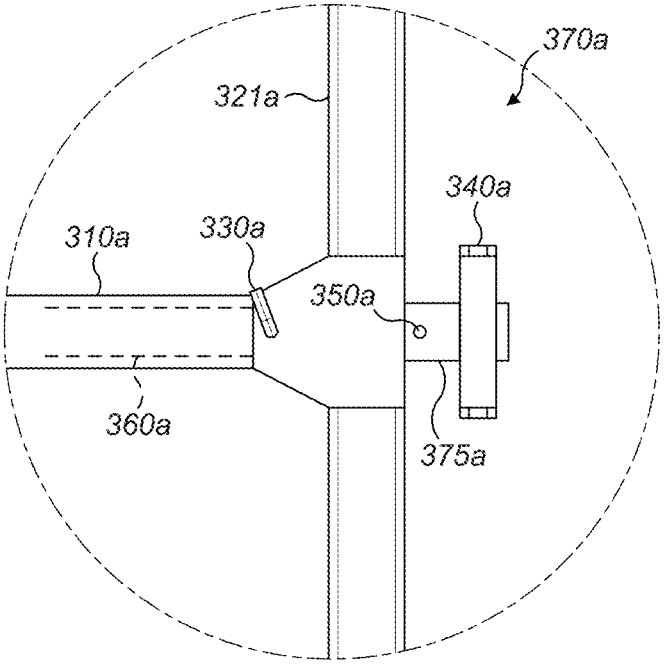

A left-side integrated adjustable handle spacing system 370*a* is shown in further detail in FIG. 3B. Shown is a left hollow weight-loading bar 310*a* with a left handlebar 375*a* inserted thereto. The left handlebar 375*a* is substantially orthogonal to the left side piece 321*a*. The left handlebar 375*a* is partially extracted from the left hollow weight-loading bar 310*a* and partially inserted (as shown by the dashed lines 360*a*). The motion of the left handlebar 375*a* (and the left handle 340*a*) may be allowed when the left locking mechanisms 350*a*/330*a* are unlocked and impeded when the left locking mechanisms 350*a*/330*a* are locked. The left locking mechanisms 350*a*/330*a* may interface with retaining slot 301*a* and stopper bolt 391*a* for locking and unlocking.

Figure 3C:
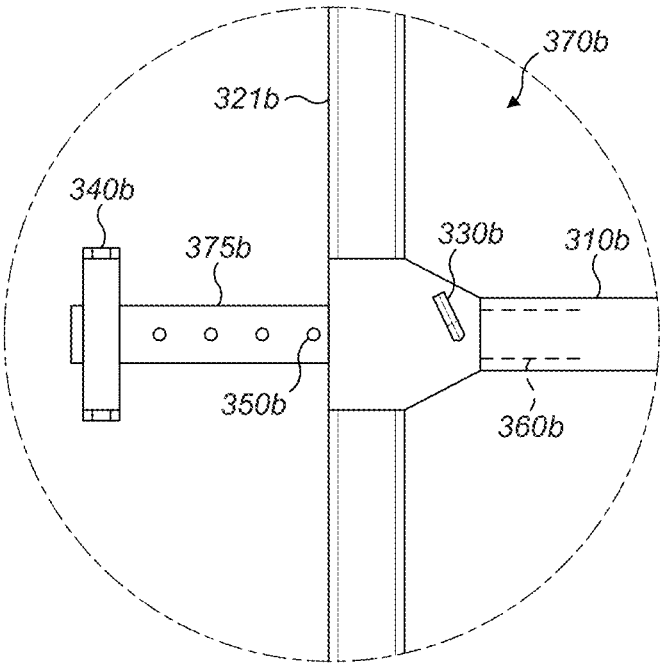

A right-side integrated adjustable handle spacing system 370*b* is shown in further detail in FIG. 3C. Shown is a right hollow weight-loading bar 310*b* with a right handle bar 375*b* inserted thereto. The right handlebar 375*b* is substantially orthogonal to the right side piece 321*b*. The right handlebar 375*b* is partially inserted into the right hollow weight-loading bar 310*b* (as shown by the dashed lines 360*b*). The motion of the right handlebar 375*b* (and the right handle 340*b*) may be allowed when the right locking mechanisms 350*b*/330*b* are unlocked and impeded when the right locking mechanisms 350*b*/330*b* are locked. The right locking mechanisms 350*b*/330*b* may interface with retaining slot 301*b* and stopper bolt 391*b* for locking and unlocking.

The construction of the trap bar allows the user to adjust the handle positions by making the distance between the user and the left handlebar 375*a* and the right handlebar 375*b* shorter or longer depending on user preference. In order to accomplish this, the user may unlock the left locking mechanisms 350*a*/330*a*, adjust the length of the left handlebar 375*a* to the user's desire and then locks in the left locking mechanisms 350*a*/330*a*. Locking pin 330*a* prevents the left handlebar 375*a* from being pulled fully from the left hollow weight-loading bar 310*a*. The user may also unlock the right locking mechanisms 350*b*, adjust the length of the right handlebar 375*b* to the user's desire and then locks the right locking mechanisms 350*b*/330*b*. Locking pin 330*b* prevents the right handlebar 375*b* from being pulled fully from the right hollow weight-loading bar 310*b*.

The user then loads and secures weights (not shown) on the left hollow weight-loading bar 310*a* and the right hollow weight-loading bar 310*b*. The user then steps within the trap bar and uses the handles 340*a*, 340*b* to lift and lower the trap bar.

The trap bar shown in FIG. 3A may incorporate the securing leg options discussed below with respect to FIGS. 7A and 7B.

3. Closed-Piece Mounted Adjustable Handle Spacing System

Figure 4:
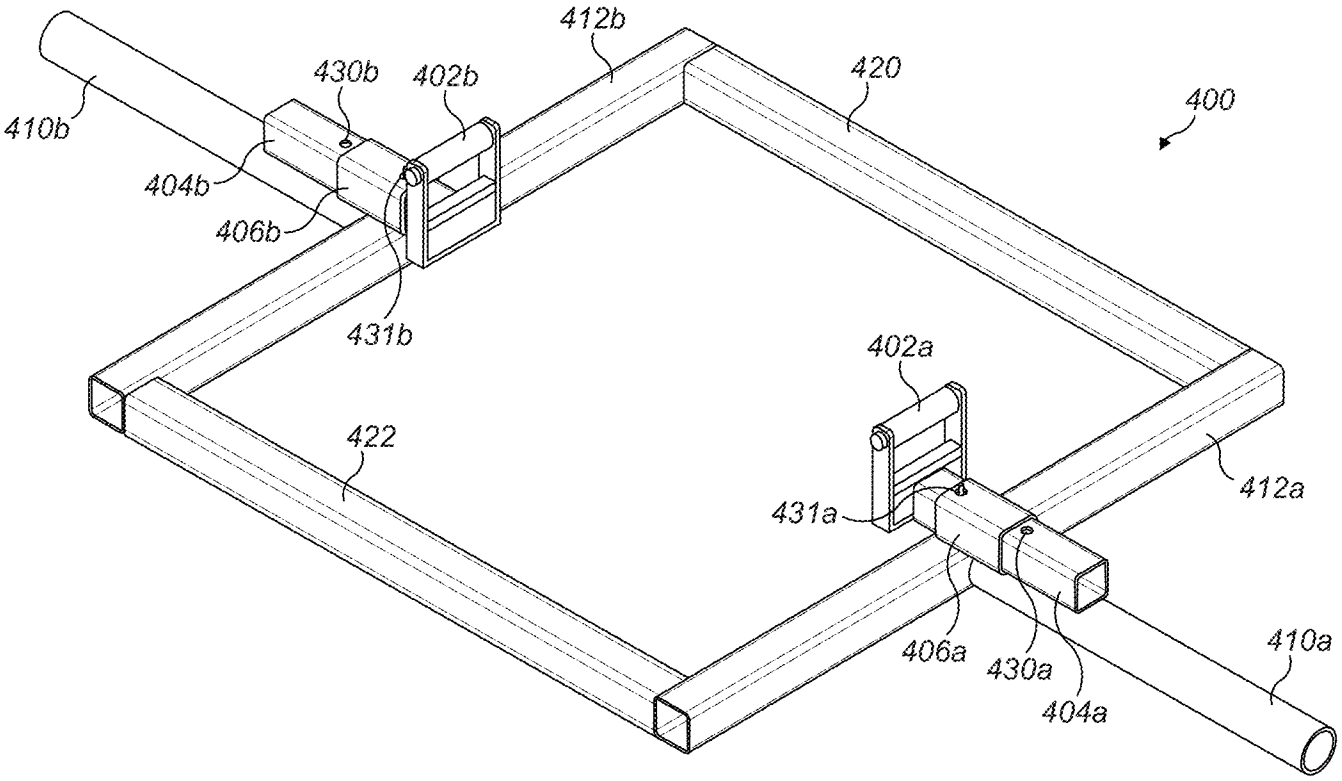
FIG. 4 shows an embodiment of a closed-piece trap bar with a mounted adjustable handle spacing system.

Turning to FIG. 4, shown is an embodiment 400 of a closed-piece trap bar with a mounted adjustable handle spacing system. In this FIG. 4, the front is facing toward the front piece 422. The closed-piece trap bar comprises a front piece 422, a back piece 420, a left side piece 412*a* and a right side piece 412*b*, all fused so as to create a rectangular shape. Fused to each of the side pieces 412*a*, 412*b* are weight-loading bars 410*a*, 410*b*, which may or may not be hollow.

A left-side mounted adjustable handle spacing system comprises a left hollow securing mechanism 406*a* fused to the top center of the left side piece 412*a*. The left handlebar 404*a* is substantially orthogonal to the left side piece 412*a* and inserted into the left hollow securing mechanism 406*a*. A left handle 402*a* is fused on top of the end of the left handlebar 404*a*. The motion of the left handlebar 404*a* (and the left handle 402*a*) may be allowed when the left locking mechanisms 430*a*, 431*a* are unlocked and impeded when the left locking mechanisms 430*a*, 431*a* are locked.

A right-side mounted adjustable handle spacing system comprises a right hollow securing mechanism 406*b* fused to the top center of the right side piece 412*b*. The right handlebar 404*b* is substantially orthogonal to the right side piece 412*b* and is inserted into the right hollow securing mechanism 406*b*. A right handle 402*b* is fused on top of the end of the right handlebar 404*b*. The motion of the right handlebar 404*b* (and the right handle 402*b*) may be allowed when the right locking mechanisms 430*b*, 431*b* are unlocked and impeded when the right locking mechanisms 430*b*, 431*b* are locked.

The construction of the trap bar allows the user to adjust the handle positions by making the left handlebar 404*a* and the right handlebar 404*b* shorter or longer depending on user preference. In order to accomplish this, the user may unlock one or more of the left locking mechanisms 430*a*, 431*a*, adjust the length of the left handlebar 404*a* to the user's desire and then locks one or more of the left locking mechanisms 430*a*, 431*a*. The user may then unlock one or more of the right locking mechanisms 430*b*, 431*b*, adjust the length of the right handlebar 404*b* to the user's desire and then locks one or more of the right locking mechanisms 430*b*, 431*b*.

The user then loads and secures weights (not shown) on the left weight-loading bar 410*a* and the right weight-loading bar 410*b*. The user then steps within the trap bar and uses the handles 402*a*, 402*b* to lift and lower the trap bar.

The trap bar shown in FIG. 4 may incorporate the securing leg options discussed below with respect to FIGS. 7A and 7B.

4. Closed-Piece Integrated Adjustable Handle Length Spacing System

Figure 5:
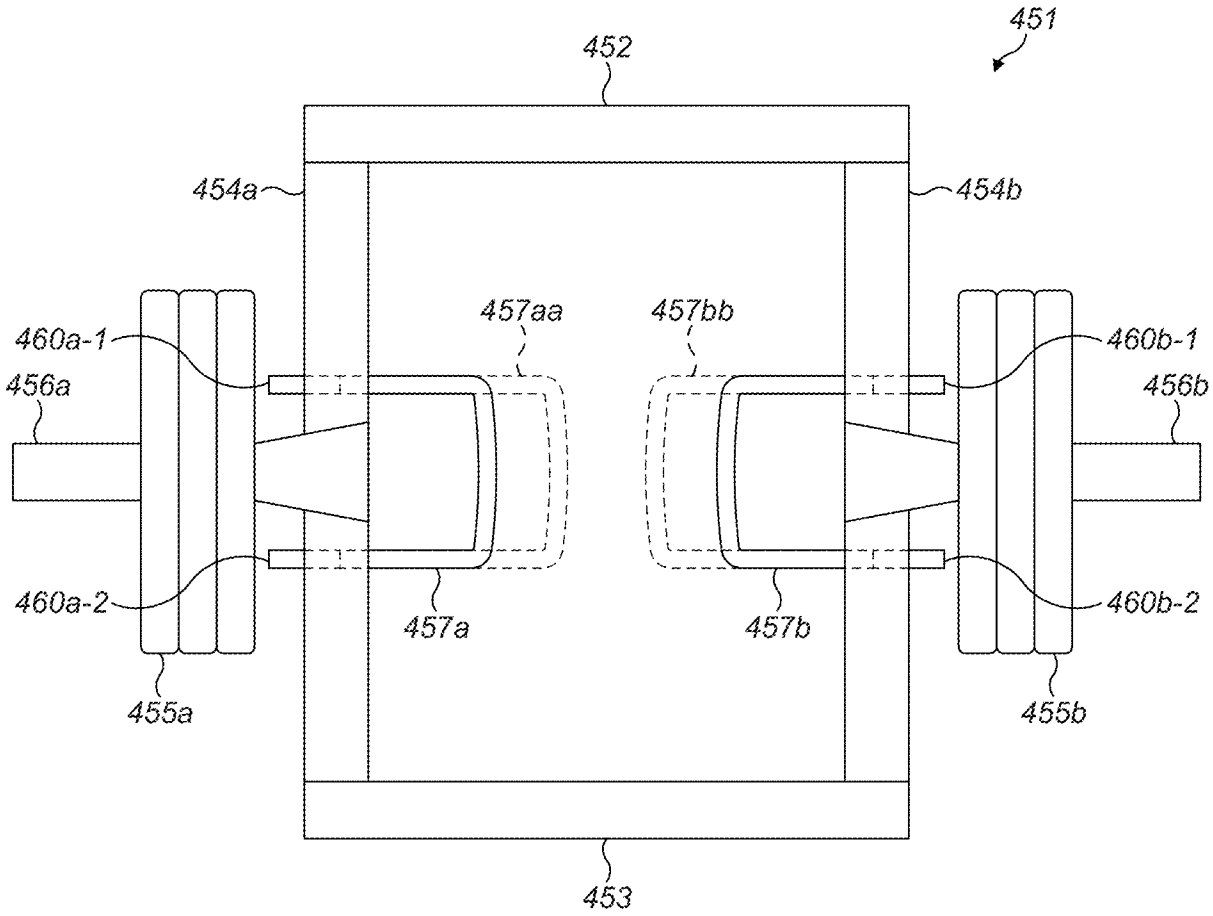
FIG. 5 shows an embodiment of a closed-piece trap bar with an integrated adjustable handle length spacing system.

Turning to FIG. 5, shown is an embodiment 451 of a closed-piece trap bar with an integrated adjustable handle length spacing system. In this FIG. 5, the front is facing toward the front piece 452. The closed-piece trap bar comprises a front piece 452, a back piece 453, a left side piece 454*a* and a right side piece 454*b*, all fused so as to create a rectangular shape. Fused to each of the side pieces 454*a*, 454*b* are weight-loading bars 456*a*, 456*b*, which may or may not be hollow.

A left-side integrated adjustable handle length spacing system comprises 2 left securing mechanisms 460*a*-1, 460*a*-2 that secure the left handlebar 457*a*. The securing mechanism allows the left handlebar 457*a* to be extended horizontally to extended handlebar position 457*aa*.

A right-side integrated adjustable handle length spacing system comprises 2 right securing mechanisms 460*b*-1, 460*b*-2 that secure the right handlebar 457*b*. The securing mechanism allows the right handlebar 457*b* to be extended horizontally to extended handlebar position 457*bb*.

The user then loads and secures weights 455*a*, 455*b* on the left weight-loading bar 456*a* and the right weight-loading bar 456*b*. The user then steps within the trap bar and uses the handles 457*a*, 457*b* to lift and lower the trap bar.

The trap bar shown in FIG. 5 may incorporate the securing leg options discussed below with respect to FIGS. 7A and 7B.

B. Open-Piece Trap Bars

Open-piece trap bars comprise a trap bar wherein the user steps into a structure that partially surrounds him or her during the lifting and lowering process. The surrounding materials may be made of any material that can withstand the weightlifting process, including without limitation metal, plastic and the like.

In the examples of open-piece trap bars set forth herein, a "U" shape is shown for the open piece. Nevertheless, other shapes of the open piece may be used including without limitation, semicircular, half-oval, half-hexagonal and the like.

1. Open-Piece Integrated Adjustable Handle Spacing System

Figure 6:
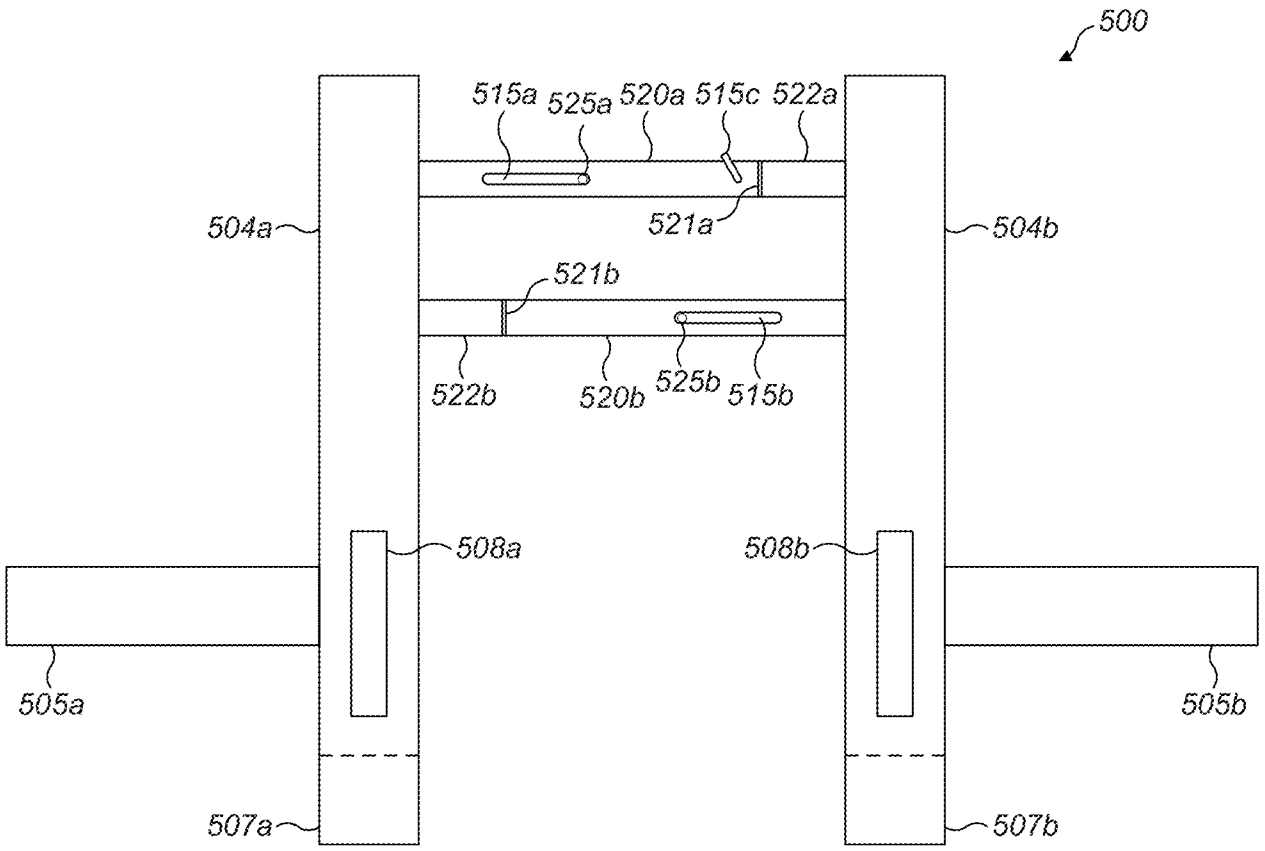
FIG. 6 shows an embodiment of an open-piece trap bar with an integrated adjustable handle spacing system.

Turning to FIG. 6, shown is an embodiment 500 of an open-piece trap bar with an integrated adjustable handle spacing system. The open-piece comprises a left side piece and a right side piece 504*a*, 504*b*, one on each side. In this FIG. 6, the front is facing toward the two sleeve pieces 520*a*, 522*a*. At the back end of the left side piece 504*a* is a left bent leg 507*a*. At the back end of the right side piece 504*b* is a right bent leg 507*b*. Fused to each of the side pieces 504*a*, 504*b* are handles 508*a*, 508*b* and weight-loading bars 505*a*, 505*b*.

The front of the trap bar includes a front set of two sleeve pieces 520*a*, 522*a* that are partially or fully hollow and built to encompass and slide along a front expansion piece (not shown) via a front cutout 521*a*. A pin 515*c* is positioned to the left of the front cutout 521*a*. A retaining slot 515*a* and a stopper bolt 525*a* prevent movement of the two sleeve pieces 520*a*, 522*a* when locked and allows movement of the two sleeve pieces 520*a*, 522*a* when unlocked.

The front of the trap bar includes a back set of two sleeve pieces 520*b*, 522*b* that are partially or fully hollow and built to encompass and slide along a front expansion piece (not shown) via a back cutout 521*b*. A retaining slot 515*b* and an optional stopper bolt 525*b* prevent movement of the two sleeve pieces 520*b*, 522*b* when locked and allows movement of the two sleeve pieces 520*b*, 522*b* when unlocked.

The back of the trap bar contains no connections.

The construction of the trap bar allows the user to adjust the trap bar by making it wider or narrower depending on user preference. In order to accomplish this, the user unlocks one or more of the locking mechanisms 515*c*. This allows the trap bar to increase or decrease in width via movement of the sleeve pieces 520*a*, 522*a*, 520*b*, 522*b* depending on the preference of the user. Once the width of the trap bar is set to the user's preference, the user then locks one or more of the locking mechanisms 515*c* to secure that width during use. The user then loads and secures weights (not shown) on the weight-loading bars 505*a*, 505*b*. (The user may use the option of the bent-leg or securing member feature of the open-piece trap bar described below to load the weights in a safer manner.) The user then steps within the trap bar and uses the handles 508*a*, 508*b* to lift and lower the trap bar.

Optionally, the nature of the shape of the left side piece and a right side piece 504*a*, 504*b* have a unique property that allows for easier and safer loading and unloading of weights on the weight-loading bars 505*a*, 505*b*. This is because the back end of the left side piece 504*a* has a left bent leg 507*a* and the back end of the right side piece 504*b* has a right bent leg 507*b*. FIG. 7B shows additional detail. Shown is a system 650 where, on the left, a leg 652*a* with a bent leg bottom 654*a* having an attached weight loading bar 660*a* (jutting into the paper, i.e., in the −z direction) that is loaded with weights 651*a*. In this position, the rest of the trap bar remains stable and stationary because the bent leg bottom 654*a* is flush with the ground. Because of this stability, easier and safer loading and unloading of weights 651*a* on the weight-loading bar 660*a* may be accomplished. These embodiments work on the left side and the right side of the open-piece trap bar in tandem. Turning to the right side of FIG. 7B, after the weight 651*a* is installed on the weight loading bar 660*a*, the leg 652*a* is upright and the bent leg bottom 654*a* is not flush with the ground. The trap bar may then be used for weight lifting.

Figure 7A:
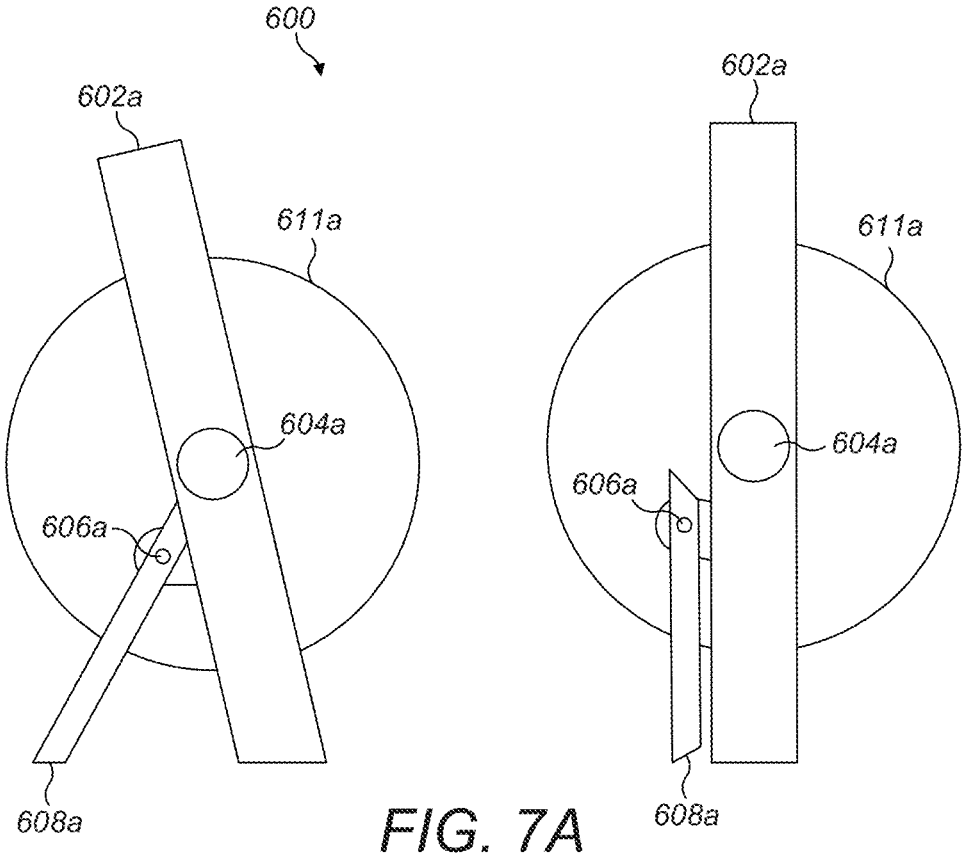
FIGS. 7A and 7B show schematics of two examples of the leg portion of an open-piece/closed-piece trap bar.
Figure 7B:
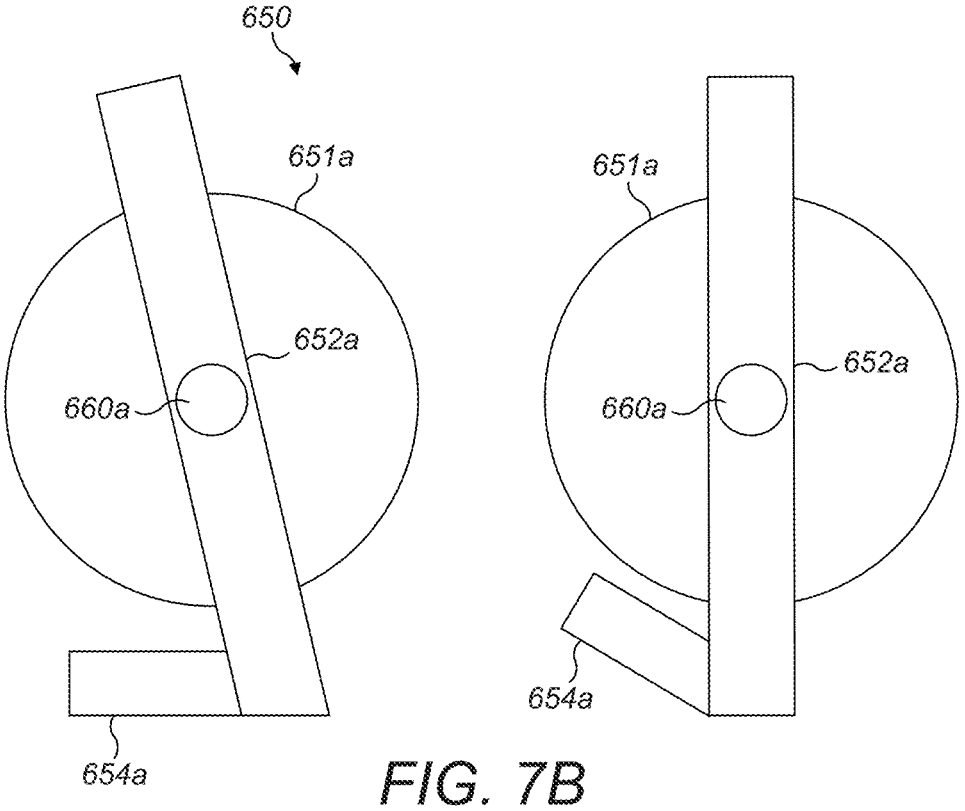

In FIG. 6, if the back end of the left side piece 504*a* does not have a left bent leg 507*a* and the back end of the right side piece 504*b* does not have a right bent leg 507*b*, FIG. 7A shows an embodiment 600 for an alternative support solution. On the left, a leg 602*a* having an attached weight loading bar 604*a* (jutting into the paper, i.e., in the −z direction) is loaded with weights 611*a*. Attached to the leg 602*a* is a securing member 608*a* with a pivot point 606*a* that is set in the supporting position. In this position, the rest of the trap bar remains stable and stationary. Because of this stability, easier and safer loading and unloading of weights 611*a* on the weight-loading bar 604*a* may be accomplished. Turning to the right side of FIG. 7A, the weight 611*a* installed on the weight loading bar 604*a* (jutting into the paper, i.e., in the −z direction) is fused to the leg 602*a* having a pivot point 606*a*. Prior to using the trap bar for weight lifting, the user then sets the pivot point 606*a* so that the securing member 608*a* is in a folded position. These embodiments work on the left side and the right side of the open-piece trap bar in tandem.

Set forth below are three other embodiments of open-piece trap bars having bent legs at the back end of the left side piece and the right side piece. These embodiments have the benefits of easy loading and unloading as described above in FIG. 7B. Alternatively, each of these embodiments may not have the bent legs and instead have the alternative support solution shown in FIG. 7A.

2. Open-Piece Integrated Adjustable Handle Spacing System

Figure 8:
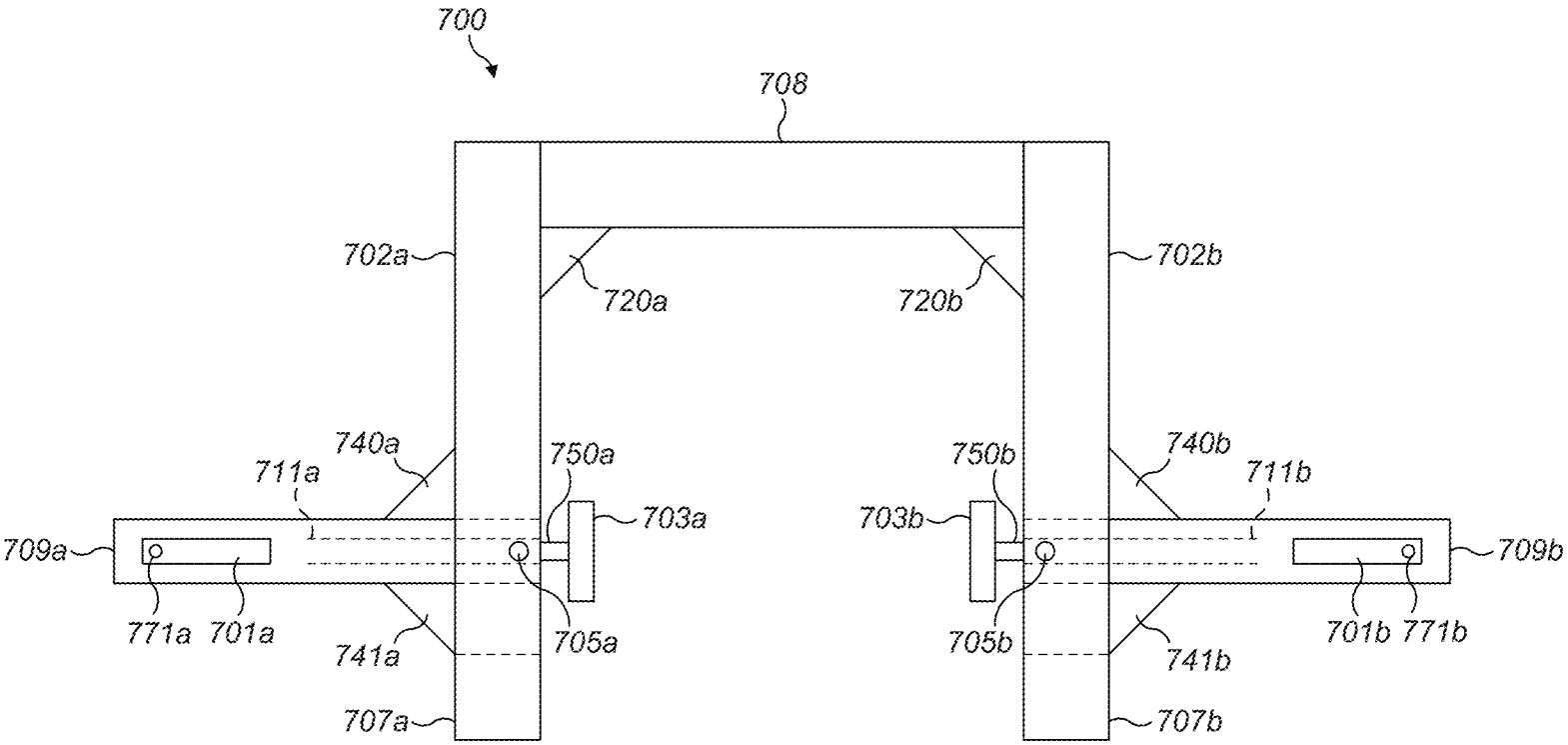
FIG. 8 shows an embodiment of an open-piece trap bar with an integrated adjustable handle spacing system.

Turning to FIG. 8, shown is an embodiment 700 of an open-piece trap bar with an integrated adjustable handle spacing system. In this FIG. 8, the front is facing toward the front piece 708. The open-piece trap bar comprises a front piece 708, a left side piece 702*a* and a right side piece 702*b*, all fused so as to create a "U" shape. At the bottom of the left side piece 702*a* is a left bent leg 707*a*. At the bottom of the right side piece 702*b* is a right bent leg 707*b*. Fused to each of the side pieces 702*a*, 702*b* are hollow weight-loading bars 709*a*, 709*b*. Struts 720*a*, 720*b*, 740*a*, 740*b*, 741*a*,741*b* may be added to provide additional stability.

On the left side, a left hollow weight-loading bar 709*a* with a left handlebar 750*a* inserted thereto. The left handlebar 750*a* is substantially orthogonal to the left side piece 702*a*. A left handle 703*a* is fused on top of the end of the left handlebar 750*a*. The left handlebar 750*a* is essentially completely inserted into the left hollow weight-loading bar 709*a* (as shown by the dashed lines 711*a*). The motion of the left handlebar 750*a* (and the left handle 703*a*) may be allowed when the left locking mechanism 705*a* is unlocked and impeded when the left locking mechanisms 705*a* is locked. Retaining slot 701*a* and stopper bolt 771*a* prevents the left handlebar 750*a* from being completely extracted from the left hollow weight-loading bar 709*a*.

On the right side, a right hollow weight-loading bar 709*b* with a right handlebar 750*b* inserted thereto. The right handlebar 750*b* is substantially orthogonal to the right side piece 702*b*. A right handle 703*b* is fused on top of the end of the right handlebar 750*b*. The right handlebar 750*b* is essentially completely inserted into the right hollow weight-loading bar 709*b* (as shown by the dashed lines 711*b*). The motion of the right handlebar 750*b* (and the right handle 703*b*) may be allowed when the right locking mechanism 705*b* is unlocked and impeded when the right locking mechanisms 705*b* is locked. Retaining slot 701*b* and stopper bolt 771*b* prevents the right handlebar 750*b* from being completely extracted from the right hollow weight-loading bar 709*b*.

The construction of the trap bar allows the user to adjust the handle positions by making the left handle 703*a* and right handle 703*b* shorter or longer depending on user preference. In order to accomplish this, the user may unlock the left locking mechanisms 705*a*, adjust the length of the left handlebar 750*a* to the user's desire and then locks one or more of the left locking mechanisms 705*a*. The user may then unlock one or more of the right locking mechanism 705*b*, adjust the length of the right handlebar 750*b* to the user's desire and then locks the right locking mechanism 705*b*.

The user then loads and secures weights (not shown) on the left hollow weight-loading bar 709*a* and the right hollow weight-loading bar 709*b*. (The user may use option of the bent-leg or securing member feature of the open-piece trap bar described above to load the weights in a safer manner.) The user then steps within the "U" space formed by the open-piece trap bar and uses the handles 703*a*, 703*b* to lift and lower the trap bar.

3. Open-Piece Mounted Adjustable Handle Spacing System

Figure 9:
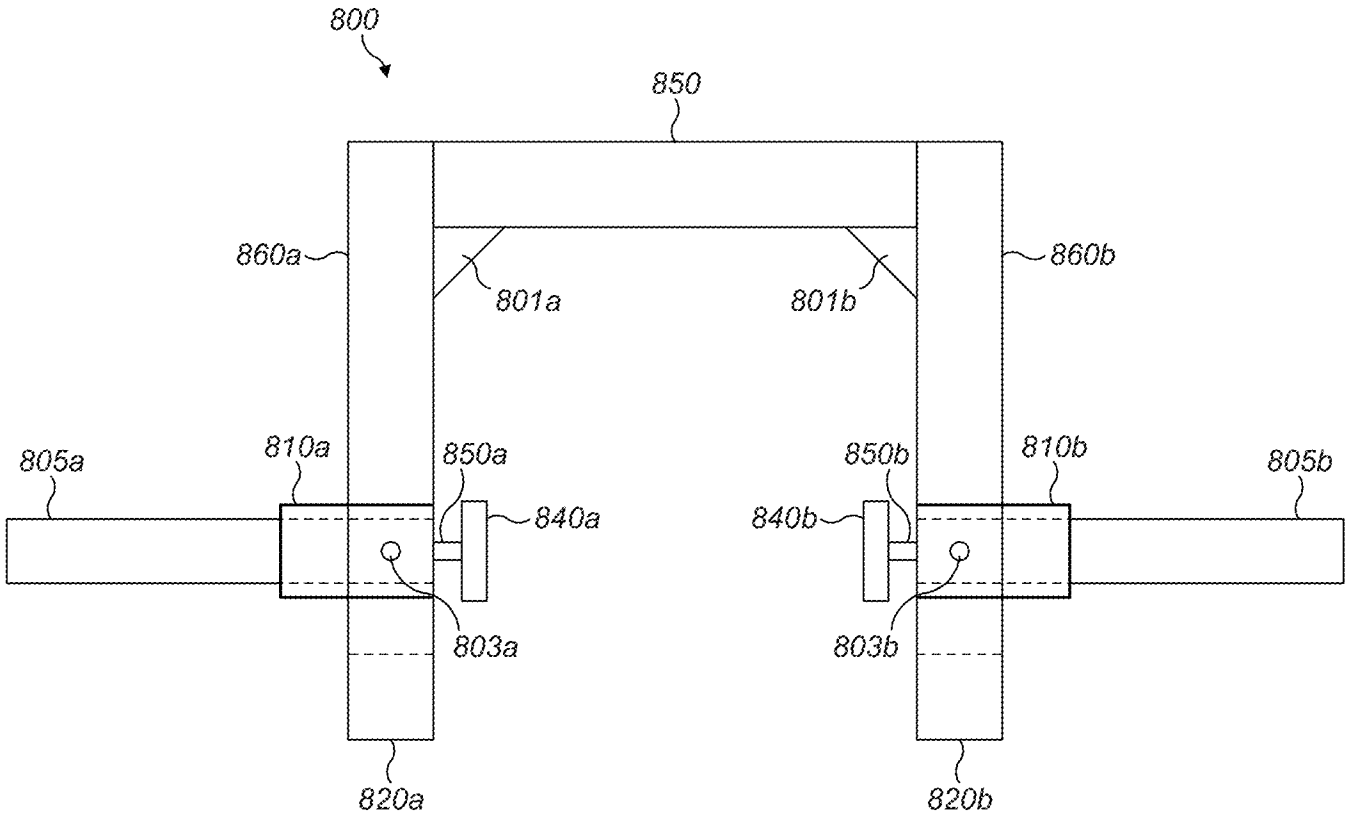
FIG. 9 shows an embodiment of an open-piece trap bar with a mounted adjustable handle spacing system.

Turning to FIG. 9, shown is an embodiment 800 of an open-piece trap bar with a mounted adjustable handle spacing system. In this FIG. 9, the front is facing toward the front piece 850. The open-piece trap bar comprises a front piece 850, a left side piece 860*a* and a right side piece 860*b*, all fused so as to create a "U" shape. Fused to each of the side pieces 860*a*, 860*b* are weight-loading bars 805*a*, 805*b*, which may or may not be hollow. At the bottom of the left side piece 860*a* is a left bent leg 820*a*. At the bottom of the right side piece 860*b* is a right bent leg 820*b*. Struts 801*a*, 801*b* may be added to provide additional stability.

A left-side mounted adjustable handle spacing system comprises a left hollow securing mechanism 810*a* fused to the top of the left side piece 860*a*. A left handlebar 850*a* is substantially orthogonal the left side piece 860*a* and is inserted into the left hollow securing mechanism 810*a*. A left handle 840*a* is fused on top of the end of the left handlebar 850*a*. The motion of the left handlebar 850*a* (and the left handle 840*a*) may be allowed when the left locking mechanism 803*a* is unlocked and impeded when the left locking mechanisms 803*a* is locked.

A right-side mounted adjustable handle spacing system comprises a right hollow securing mechanism 810*b* fused to the top of the right side piece 860*b*. A right handlebar 850*b* is substantially orthogonal the right side piece 860*b* and is inserted into the right hollow securing mechanism 810*b*. A right handle 840*b* is fused on top of the end of the right handlebar 850*b*. The motion of the right handlebar 850*b* (and the right handle 840*b*) may be allowed when the right locking mechanism 803*b* is unlocked and impeded when the right locking mechanism 803*b* is locked.

The construction of the trap bar allows the user to adjust the handle positions by making the left handlebar 850*a* and right handlebar 850*b* shorter or longer depending on user preference. In order to accomplish this, the user may unlock a left locking mechanism 803*a*, adjust the length of the left handlebar 850*a* to the user's desire and then locks a left locking mechanism 803*a*. The user may then unlock a right locking mechanisms 803*b*, adjust the length of the right handlebar 850*b* to the user's desire and then locks a right locking mechanism 803*b*.

The user then loads and secures weights (not shown) on the left weight-loading bar 805*a* and the right weight-loading bar 805*b*. (The user may use the option of the bent-leg or securing member feature of the open-piece trap bar described above to load the weights in a safer manner.) The user then steps within the "U" space formed by the open-piece trap bar and uses the handles 840*a*, 840*b* to lift and lower the trap bar.

4. Open-Piece Integrated Adjustable Handle Length Spacing System

Figure 10:
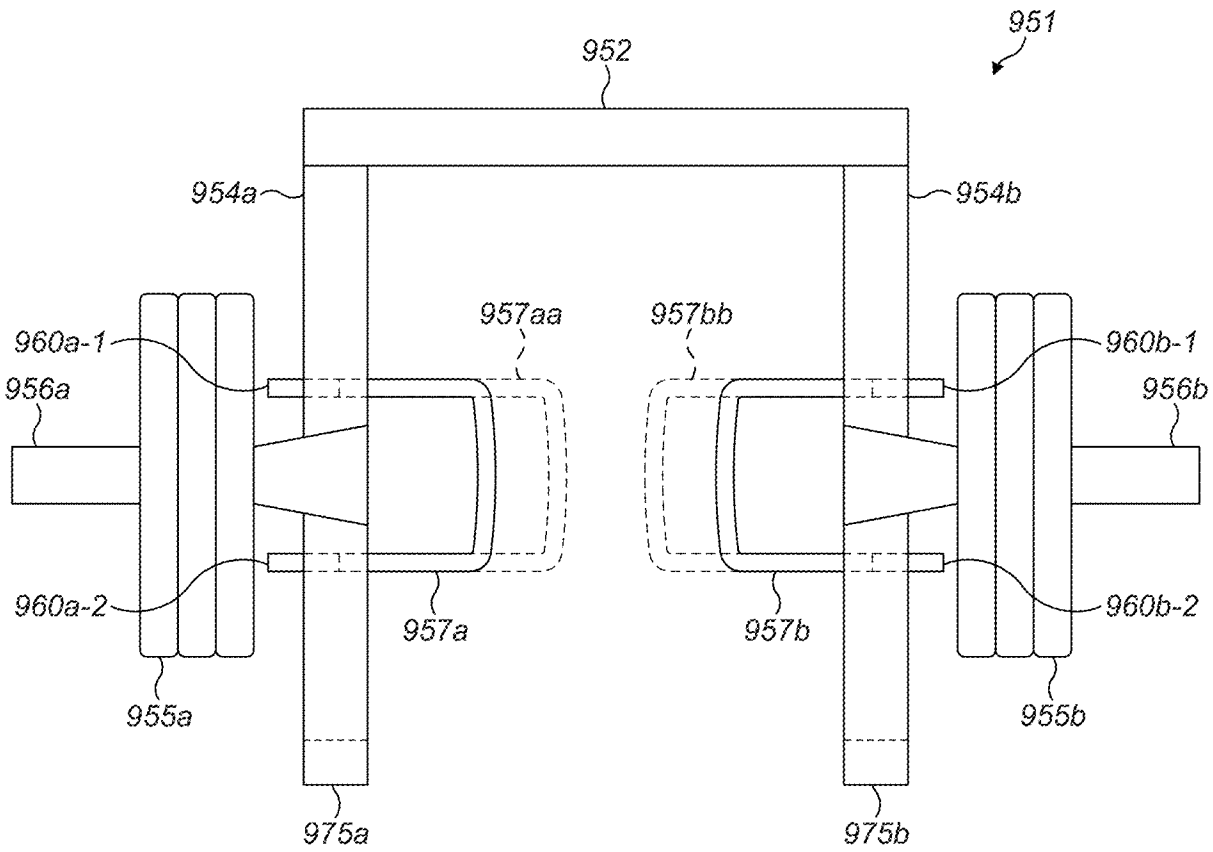
FIG. 10 shows an embodiment of an open-piece trap bar with an integrated adjustable handle length spacing system.

Turning to FIG. 10, shown is an embodiment 951 of an open-piece trap bar with an integrated adjustable handle length spacing system. In this FIG. 10, the front is facing toward the front piece 952. The open-piece trap bar comprises a front piece 952, a left side piece 954*a* and a right side piece 954*b*, all fused so as to create a "U" shape. Fused to each of the side pieces 954*a*, 954*b* are weight-loading bars 956*a*, 956*b*, which may or may not be hollow. At the bottom of the left side piece 954*a* is a left bent leg 975*a*. At the bottom of the right side piece 954*b* is a right bent leg 975*b*.

A left-side integrated adjustable handle length spacing system comprises 2 left securing mechanisms 960*a*-1, 960*a*-2 that secures the left handlebar 957*a*. The securing mechanism allows the left handlebar 957*a* to be horizontally extended over to the left extended handlebar position 957*aa*.

A right-side integrated adjustable handle length spacing system comprises 2 right securing mechanisms 960*b*-1, 960*b*-2 that secures the right handlebar 957*b*. The securing mechanism allows the right handlebar 957*b* to be extended overto the right extended handlebar position 957*bb*.

The user then loads and secures weights (not shown) on the left weight-loading bar 956*a* and the right weight-loading bar 956*b*. (The user may use option of the bent-leg or securing member feature of the open-piece trap bar described above to load the weights in a safer manner.) The user then steps within the trap bar and uses the handles 957*a*, 957*b* to lift and lower the trap bar.

III. Conclusion

In the foregoing specification, specific embodiments have been described. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of present teachings.

The benefits, advantages, solutions to problems, and any element(s) that may cause any benefit, advantage, or solution to occur or become more pronounced are not to be construed as a critical, required, or essential features or elements of any or all the claims. The invention is defined solely by the appended claims including any amendments made during the pendency of this application and all equivalents of those claims as issued.

Moreover, in this document, relational terms such as first and second, top and bottom, and the like may be used solely to distinguish one entity or action from another entity or action without necessarily requiring or implying any actual such relationship or order between such entities or actions. The terms "comprises," "comprising," "has", "having," "includes", "including," "contains", "containing" or any other variation thereof, are intended to cover a non-exclusive inclusion, such that a process, method, article, or apparatus that comprises, has, includes, contains a list of elements does not include only those elements but may include other elements not expressly listed or inherent to such process, method, article, or apparatus. An element proceeded by "comprises . . . a", "has . . . a", "includes . . . a", "contains . . . a" does not, without more constraints, preclude the existence of additional identical elements in the process, method, article, or apparatus that comprises, has, includes, contains the element. The terms "a" and "an" are defined as one or more unless explicitly stated otherwise herein. The terms "substantially", "essentially", "approximately", "about" or any other version thereof, are defined as being close to as understood by one of ordinary skill in the art. The term "coupled" as used herein is defined as connected, although not necessarily directly and not necessarily mechanically. A device or structure that is "configured" in a certain way is configured in at least that way, but may also be configured in ways that are not listed.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various embodiments for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus the following claims are hereby incorporated into the Detailed Description, with each claim standing on its own as a separately claimed subject matter.

We claim:

1. A weight-lifting apparatus comprising:

a first side piece having a first side piece left side, a first side piece right side, a first side piece top side, a first top end and a first bottom end;

a second side piece having a second side piece left side, a second side piece right side and a second side piece top side, a second top end and a second bottom end;

a left weight-loading bar jutting out in the left direction fused to the first side piece;

a right weight-loading bar jutting out in the right direction fused to the second side piece;

a front piece having a front left end and a front right end;

a rear piece having a rear left end and a rear right end;

wherein the first top end is fused with the rear left end;

wherein the first bottom end is fused with the front left end;

wherein the second top end is fused with the rear right end;

wherein the second bottom end is fused with the front right end;

a left handle support bar substantially orthogonal to the first side piece and secured to the first side piece;

a right handle support bar substantially orthogonal to the second side piece secured to the second side piece;

a left handle fused to a right end of the left handle support bar;

a right handle fused to a left end of the right handle support bar;

a left locking mechanism that selectively allows and prevents movement of the left handle support bar; and a right locking mechanism that selectively allows and prevents movement of the right handle support bar;

wherein the left weight-loading bar comprises a left hollow portion, and wherein the left handle support bar is selectively insertable and removable from the left hollow portion, and wherein the right weight-loading bar comprises a right hollow portion, and wherein the right handle support bar is selectively insertable and removable from the right hollow portion.

2. The weight-lifting apparatus as in claim 1, wherein the left locking mechanism interfaces with a left stopper bolt and the right locking mechanism interfaces with a right stopper bolt.

3. The weight-lifting apparatus as in claim 2, wherein the first bottom end is bent with respect to the rest of the first side piece; and wherein the second bottom end is bent with respect to the rest of the second side piece.

4. The weight-lifting apparatus as in claim 2, further comprising:

a first securing member secured to the first side piece that is selectively locatable adjacent to and offset from the first side piece; and a second securing member secured to the second side piece that is selectively locatable adjacent to and offset from the second side piece.

5. The weight-lifting apparatus as in claim 1, wherein the first bottom end is bent with respect to the rest of the first side piece; and wherein the second bottom end is bent with respect to the rest of the second side piece.

6. The weight-lifting apparatus as in claim 1, further comprising:

a first securing member secured to the first side piece that is selectively locatable adjacent to and offset from the first side piece; and a second securing member secured to the second side piece that is selectively locatable adjacent to and offset from the second side piece.

7. A weight-lifting apparatus comprising:

a first side piece having a first side piece left side, a first side piece right side, a first side piece top side, a first top end and a first bottom end, wherein the first bottom end has a first support mechanism;

a second side piece having a second side piece left side, a second side piece right side and a second side piece top side, a second top end and a second bottom end, wherein the second bottom end has a second support mechanism;

a left weight-loading bar jutting out in the left direction fused to the first side piece;

a right weight-loading bar jutting out in the right direction fused to the second side piece;

a front piece having a front left end and a front right end;

wherein the first top end is fused with the front left end;

wherein the second top end is fused with the front right end;

a left handle support bar substantially orthogonal to the first side piece and secured to the first side piece;

a right handle support bar substantially orthogonal to the second side piece secured to the second side piece;

a left handle fused to a right end of the left handle support bar;

a right handle fused to a left end of the right handle support bar;

a left locking mechanism that selectively allows and prevents movement of the left handle support bar;

a right locking mechanism that selectively allows and prevents movement of the right handle support bar;

wherein the left weight-loading bar comprises a left hollow portion, and wherein the left handle support bar is selectively insertable and removable from the left hollow portion, and wherein the right weight-loading bar comprises a right hollow portion, and wherein the right handle support bar is selectively insertable and removable from the right hollow portion.

8. The weight-lifting apparatus as in claim 7, wherein the left locking mechanism interfaces with a left stopper bolt and the right locking mechanism interfaces with a right stopper bolt.

9. The weight-lifting apparatus as in claim 8, wherein the first support mechanism comprises the first bottom end that is bent with respect to the rest of the first side piece, and wherein the second support mechanism comprises the second bottom end that is bent with respect to the rest of the second side piece.

10. The weight-lifting apparatus as in claim 8, wherein the first support mechanism comprises a first securing member secured to the first side piece that is selectively locatable adjacent to and offset from the first side piece, and wherein the second support mechanism comprises a second securing member secured to the second side piece that is selectively locatable adjacent to and offset from the second side piece.

11. The weight-lifting apparatus as in claim 7, wherein the first support mechanism comprises the first bottom end that is bent with respect to the rest of the first side piece, and wherein the second support mechanism comprises the second bottom end that is bent with respect to the rest of the second side piece.

12. The weight-lifting apparatus as in claim 7, wherein the first support mechanism comprises a first securing member secured to the first side piece that is selectively locatable adjacent to and offset from the first side piece, and wherein the second support mechanism comprises a second securing member secured to the second side piece that is selectively locatable adjacent to and offset from the second side piece.

* * * * *